US008059846B2

(12) United States Patent
Vaerndal et al.

(10) Patent No.: US 8,059,846 B2
(45) Date of Patent: Nov. 15, 2011

(54) SWITCHING DEVICE FOR HEARING AID

(75) Inventors: Rune Vaerndal, Smørum (DK); Peter Spragge, Smørum (DK)

(73) Assignee: Opticon A/S, Smørum (DK)

( * ) Notice: Subject to any disclaimer, the term of this patent is extended or adjusted under 35 U.S.C. 154(b) by 246 days.

(21) Appl. No.: 12/450,732

(22) PCT Filed: Oct. 4, 2008

(86) PCT No.: PCT/EP2008/054324

§ 371 (c)(1),
(2), (4) Date: Oct. 9, 2009

(87) PCT Pub. No.: WO2008/125584

PCT Pub. Date: Oct. 23, 2008

(65) Prior Publication Data

US 2010/0034408 A1 Feb. 11, 2010

(30) Foreign Application Priority Data

Apr. 12, 2007 (EP) ..... 07106055

(51) Int. Cl.
*H04R 25/00* (2006.01)

(52) U.S. Cl. ..... 381/324; 381/322

(58) Field of Classification Search ..... 200/556; 381/312, 314, 315, 322, 323, 324
See application file for complete search history.

(56) References Cited

U.S. PATENT DOCUMENTS

| | | | | |
|---|---|---|---|---|
| 5,803,243 | A | 9/1998 | Nestor et al. | |
| 5,957,273 | A | 9/1999 | Karasik | |
| 6,658,125 | B1 * | 12/2003 | Batting | 381/330 |
| 7,394,911 | B2 * | 7/2008 | Joergensen et al. | 381/324 |
| 2003/0094353 | A1 | 5/2003 | Ravnkilde et al. | |

FOREIGN PATENT DOCUMENTS

| | | |
|---|---|---|
| EP | 0337195 | 10/1989 |

OTHER PUBLICATIONS

English Abstract of EP 0337195 : Oct. 18, 1989.

* cited by examiner

*Primary Examiner* — Brian Ensey
(74) *Attorney, Agent, or Firm* — Dykema Gossett PLLC

(57) ABSTRACT

Switching device for hearing aid, whereby a hearing aid casing part is adapted for placement above and behind the ear lobe and encloses a battery and a signal processing and amplifier device operable to provide an amplified audio signal to the user perceivable as sound wherein further the switching device comprises a base section and a manually operable rigid pivot element which has a two spaced apart pressure receiving parts and a pivotal axis placed between the two pressure receiving parts, whereby a cantilever and indexing ladder is provided between the base section and the rigid pivot element operable to allow the rigid pivot element to assume 2, 3 or more stable positions.

8 Claims, 5 Drawing Sheets

SWITCHING DEVICE FOR HEARING AID

AREA OF THE INVENTION

The invention relates to a switching element for a hearing aid whereby the user may effect program shift or in other ways change the setting or state of the signal processor in the hearing aid.

BACKGROUND OF THE INVENTION

In modern hearing aid design it has become customary for BTE hearing aids to provide a printed circuit board (PCB) running horizontally along the length axis and at the back end of the hearing aid this PCB extends on top of and along a battery and a receiver housing. It is further desired to arrange a switching device which is manually operable by finger touch in this area. Preferably such a switching device will have to control the position of electrical switches mounted onto the PCB in this area, where very little space is available and at the same time the switching device should not cause any increase in the size of the hearing aid casing. The invention provides a switching device, which can be built into the casing of a hearing aid and provide fail-safe multiposition switching which both allows tactile feedback to the user, who may feel the position of the switch and at the same time also a visible feedback is provided, such that caregivers may ascertain the position of the switch by visual inspection.

SUMMARY OF THE INVENTION

According to the invention a switching device for hearing aid is provided whereby a hearing aid casing part is adapted for placement above and behind the ear lobe and encloses a battery and a sound processing and amplifier device operable to provide an amplified audio signal to the user perceivable as sound wherein further the switching device comprises a base section and a manually operable rigid pivot element which has two spaced apart pressure receiving parts and a pivotal axis placed between the two pressure receiving parts, whereby a cantilever and indexing ladder is provided between the base section and the rigid pivot element operable to allow the rigid pivot element to assume 2, 3 or more stable positions.

This allows the switching element to be made rather flat, and with only the one or the other of the pressure receiving parts of the pivotal element will extend beyond the surface of the casing. Further the cantilever and ladder may be provided beneath the pivotal element, such that these parts remain hidden for the user. Further it should be noted that the pressure to be supplied to the pressure receiving parts of the pivot will be in the downward direction, which will aid to ensure that switching may take place without moving the hearing aid away from its right position on the ear lobe. Further, it should be noted that the switching device is a mechanical element, and the mechanical design of this part is then independent from the setup of the electronic switch elements which are provided underneath on the PCB. Also the positioning of the electrical switches with respect to the mechanical switching element is not very critical which facilitates both ease of production and design of the hearing aid.

In an embodiment of the invention each of the pressure receiving parts are operable to alternately assume either a stable position flush with the surrounding hearing aid casing part or a stable position raised above the surrounding hearing aid casing part. In this manner the user may pivot the pivot element between the here defined two stable positions by simply pushing the part of the pivotable element not being flush with the surface of the hearing aid.

In a further embodiment, one or more additional stable positions are provided by the cantilever and indexing ladder wherein both pressure receiving parts are raised above the surrounding hearing aid casing part. Such intermediate positions will allow the switching element to have more than the two stable positions initially described. Also the cantilever and indexing ladder provides the advantage that the actuation force may easily be scaled according to desired values.

In a further embodiment, the cantilever is provided as a part of the base part and the indexing ladder is provided integrally with the pivot element. This arrangement allows the ladder and cantilever to remain invisible under the pivotal part. However, it is also possible to interchange the cantilever and the indexing ladder such that the ladder is made integral with the base part and the cantilever is made as part of the pivot element.

In a further embodiment the pivot element comprises a skirt surrounding each pressure receiving part and extending in the same direction as the force provided by the intended pressure applied to change the position of the switching device. Such a skirt serves the purpose of enclosing and hiding the elements provided beneath the pivotal part such as the indexing ladder, the cantilever and the electrical switches. Also the skirt may serve to receive pressure from the user if attempts are made to press the switching device beyond its natural stable position flush with the hearing aid casing.

In a further embodiment the invention concerns a hearing aid with a switching device, wherein a hearing aid casing part is adapted for placement above and behind the ear lobe and encloses a battery and a sound processing and amplifier device operable to provide an amplified audio signal to the user perceivable as sound wherein the battery and a speaker is provided close to each other and where the switching device is provided in the region above the battery and the speaker wherein further the switching device comprises a base section and a manually operable rigid pivot element which has two spaced apart pressure receiving parts and a pivotal axis placed between the two pressure receiving parts, whereby a cantilever and indexing ladder is provided between the base section and the rigid pivot element operable to allow the rigid pivot element to assume 2, 3 or more stable positions.

A hearing aid with a switching device is thus provided, where the switching device may be provided in the region of the battery and receiver without resulting in a bulky hearing aid.

DESCRIPTION OF A PREFERRED EMBODIMENT

Figure 3:
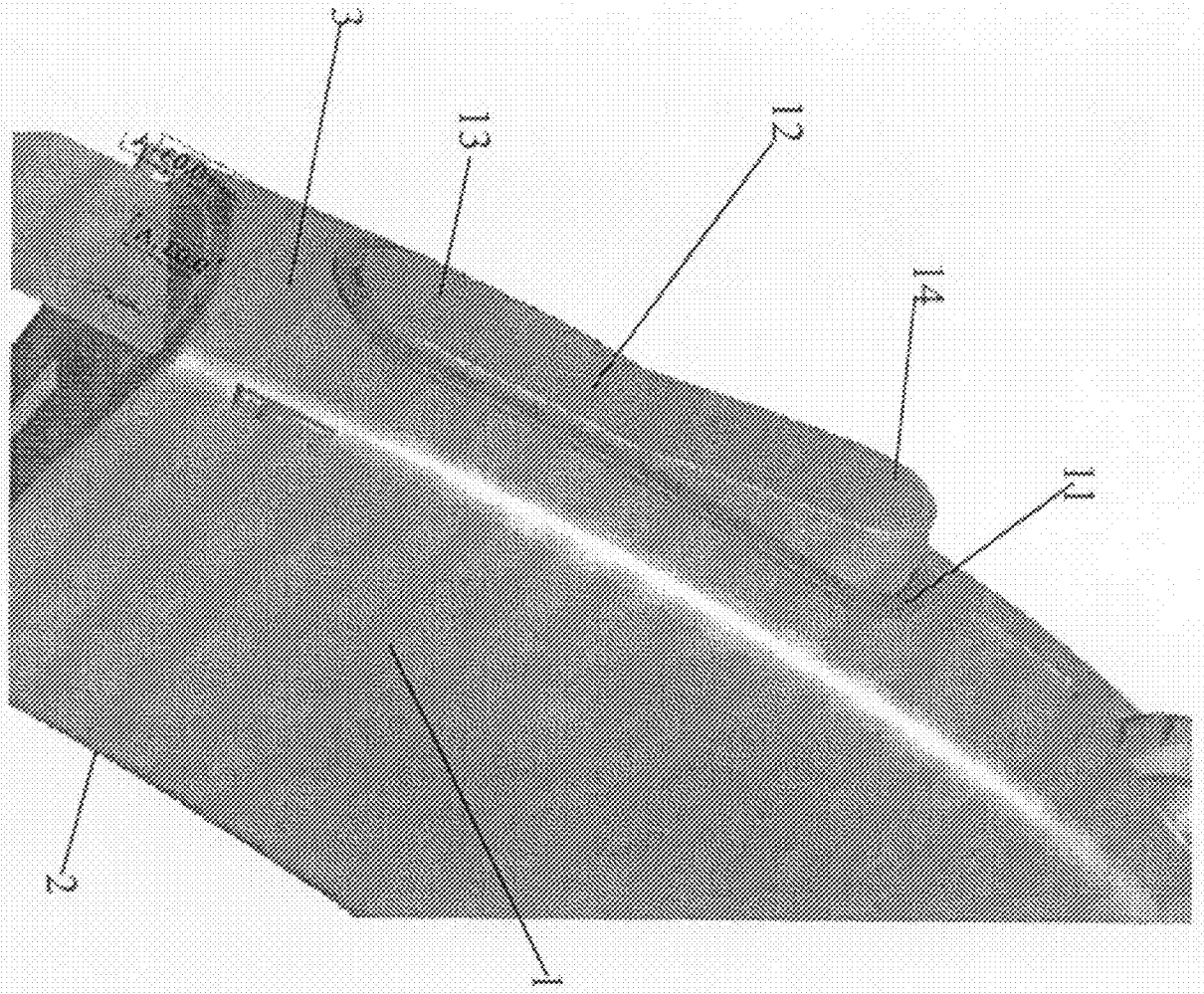
FIG. 3 shows an elevated view of a hearing aid according to the invention with a switch provided in the hearing aid casing.
Figure 4:
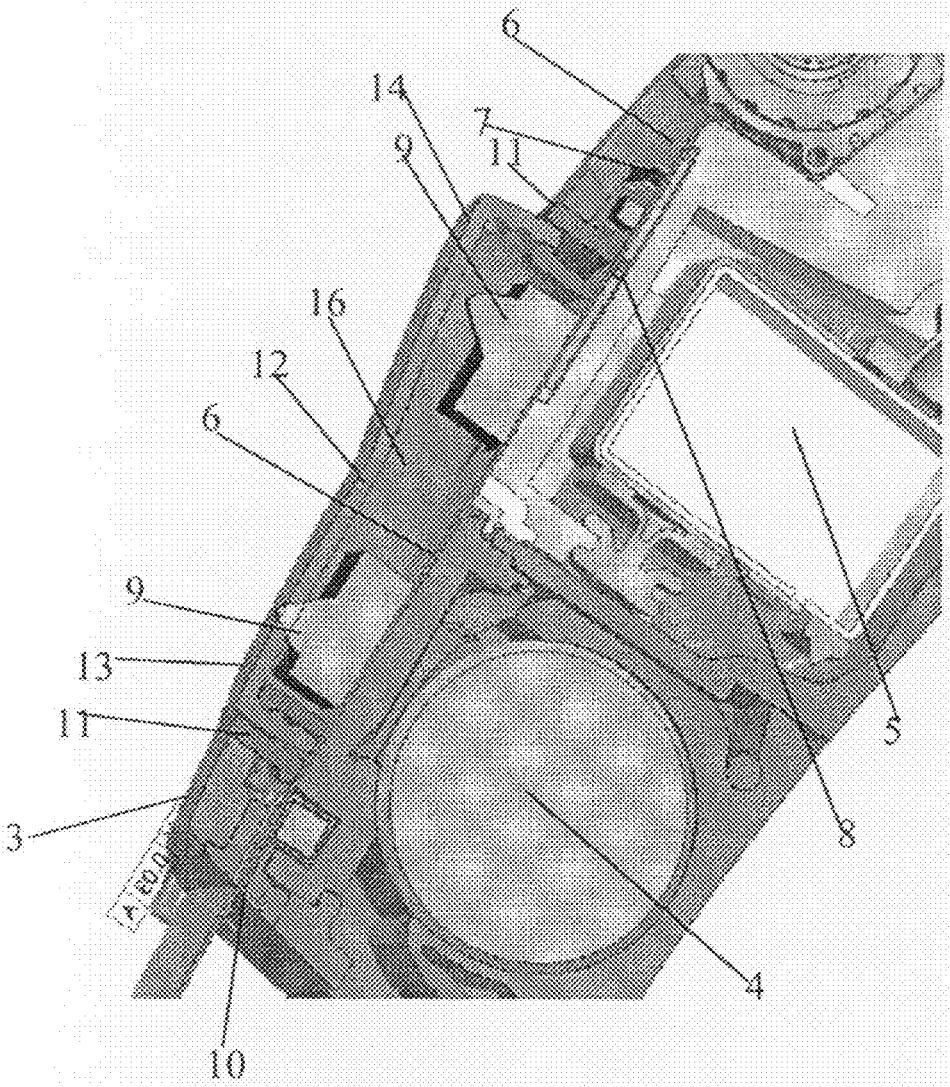
FIG. 4 is an elevated view of a section of a hearing aid with the switching element according to the invention.

In FIG. 3 a part of the hearing aid casing 1 is visible. The casing is elongate with a rounded lower part and a smooth upper part 3. The rounded lower part 2 facilitates placement of the hearing aid at the ear lobe in the usual way (not shown). As seen in FIG. 4 the casing 1 encloses a battery 4 and a receiver or speaker 5 and on top of these two elements just below the upper part 3 a PCB 6 is provided with electronic parts 7, 8, 9 provided thereon. Among the electronic parts 7, 8, 9 especially the sound processing and amplifier device 8 is important, as this is the part which enhances the sound according to the needs of the user. All electronic parts, the battery 4, the receiver 5, electrical switches 9, capacitors 7, the microphone or microphones (not shown) and programming socket 10 and possible other elements such as a wireless antenna are connected through the PCB to the processing and amplifier device 8.

Figure 1:
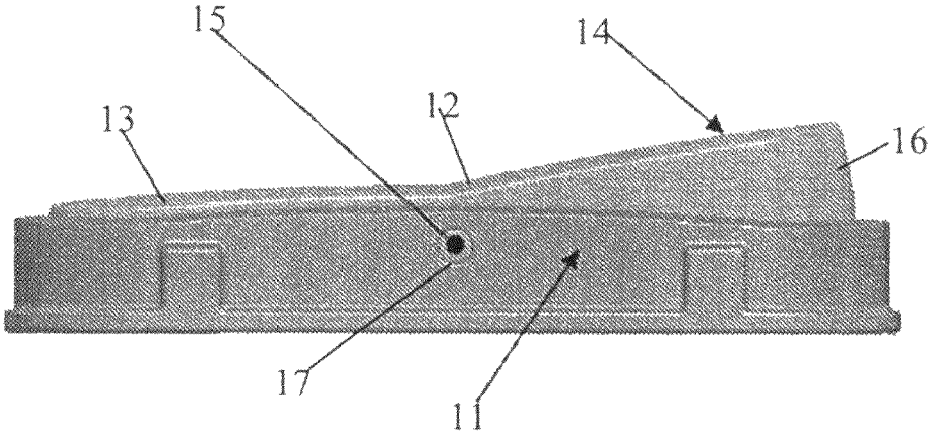
FIG. 1 shows a side view of the switch.

The switching device as seen in the figures comprises a base section 11 and a rigid pivot element 12. The pivot element 12 has two pressure receiving parts 13, 14 which are spaced apart and has a pivotal axle 15 placed centrally there between. The axle 15 is seen in FIG. 1, and in one embodiment the axle comprise a protrusion on a skirt portion, which is positioned in a recess or hole 17 in the base part 11.

Figure 2:
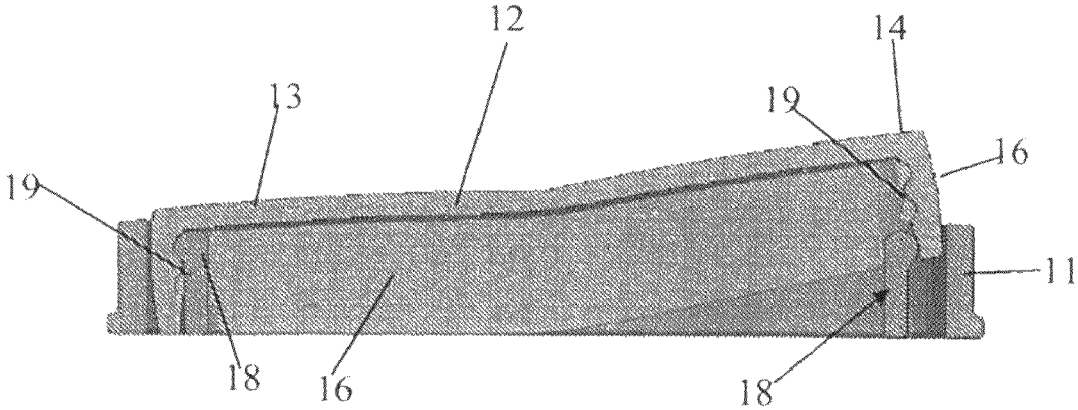
FIG. 2 shows a section through the switch body.

As best seen in FIG. 2 the cantilever 18 is shaped integrally with the base part 11 and the indexing ladder 19 is shaped at the inside of the skirt 16 at each end of the switching device. In the position seen in FIG. 2 the one pressure receiving part 13 is pressed all the way down and a protrusion on the cantilever 18 at this end is placed in the first of a number of recesses of the indexing ladder 19. As also seen in FIG. 2 the other pressure receiving part 14 of the pivot element is now raised above the base part 11 and a protrusion on the cantilever 18 at this end is placed in the last one of a number of recesses of the indexing ladder 19. A number of recesses may be provided allowing the pivot 12 to be fixed at intermediate but stable positions between the two described above.

When the protrusion on the cantilever enters a recess on the indexing ladder this may cause a clear and easily detectable click, which indicates to the user that the desired position has been reached.

As seen in FIGS. 3 and 4 the pressure receiving part 13 is flush or substantially flush with the base part 11 and the hearing aid shell upper part 3 when the pressure receiving part 13 is pressed towards its lowermost position, and similarly, (but not shown) the other pressure receiving part 14 will be flush with its surroundings when pressed to its lowermost position.

In FIG. 4 electric switches 9 are shown below each pressure receiving part 13, 14 and when the pivot 12 is moved in the above described manner the switches are caused to change position and this is registrable in the signal processing device 8 and may cause shifting in the way the processing device functions, such as cause a change of program.

As seen in FIG. 4 the skirt 16 is raised above the base part 11 and by this arrangement the electrical switches 9 remain at all times covered and protected from detrimental influences from the environment.

In the described embodiment the switches are soldered directly onto the PCB 6 which is placed in the space between the casing upper part 3 and the battery 4 and receiver 5.

Figure 5:
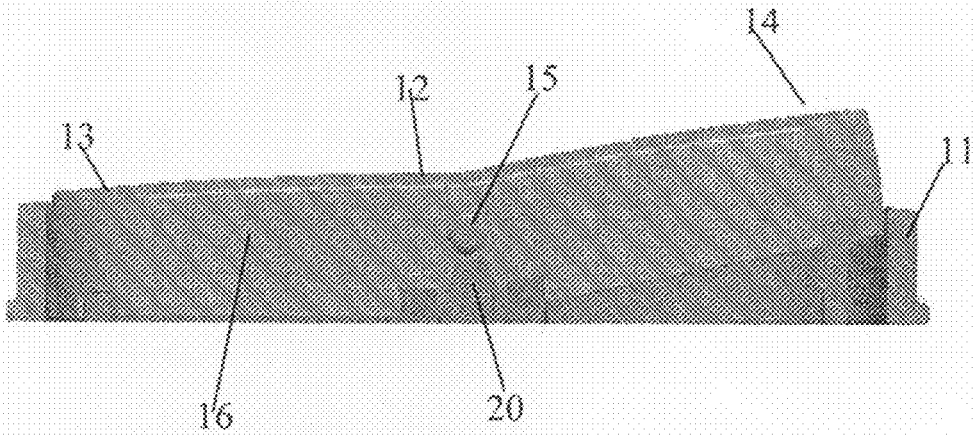
FIG. 5 is a partial sectional view of a further embodiment of the invention.

In FIG. 5 a further embodiment of the invention is shown, wherein the rigid pivot element 12 in the skirt 16 has a recess or cut out region 20 just below the axle 15. This will allow the pivot element 12 to flex such that both pressure receiving parts 13, 14 may be forced downward to the base element 11. In this way it will be possible to close the electrical switches which may be placed under both of the pressure receiving parts 13, 14 simultaneously. This will allow a further switching option in the switching device. The pressure needed to force both of the pressure receiving elements downward will necessarily have to be bigger than the force needed to just pivot the pivotal element 12, and thus for normal pressure the pivot will still have a rigid character, but when both ends are forcefully pressed the mid section weakened by the cut out region 20 in the skirt 16 will yield. The cut out region 20 is only one way of weakening the mid part of the pivot, and the skilled person will easily provide other solutions to the problem such as thinning the wall thickness in a region.

Figure 6:
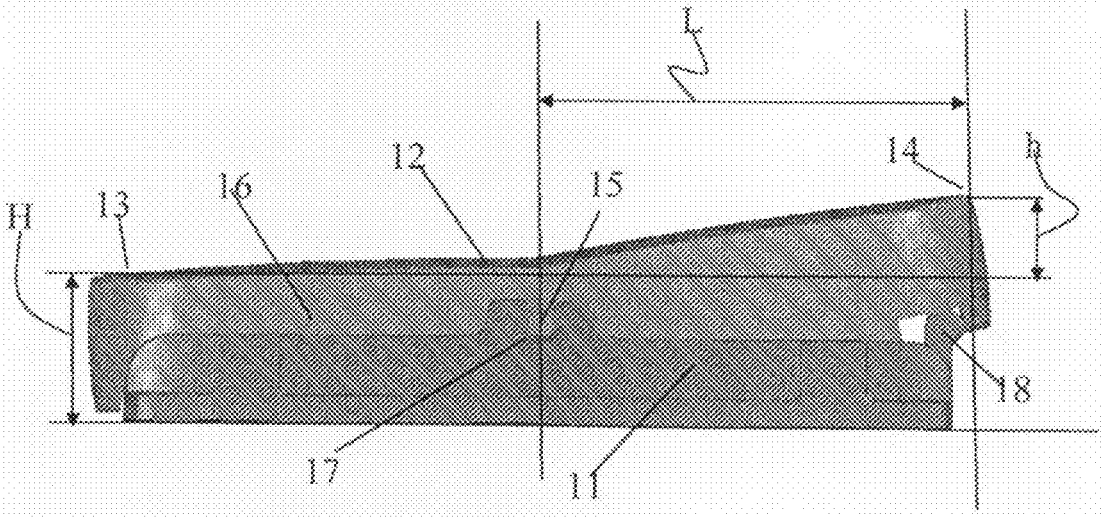
FIG. 6 is a side view of a further embodiment of the switch.
Figure 7:
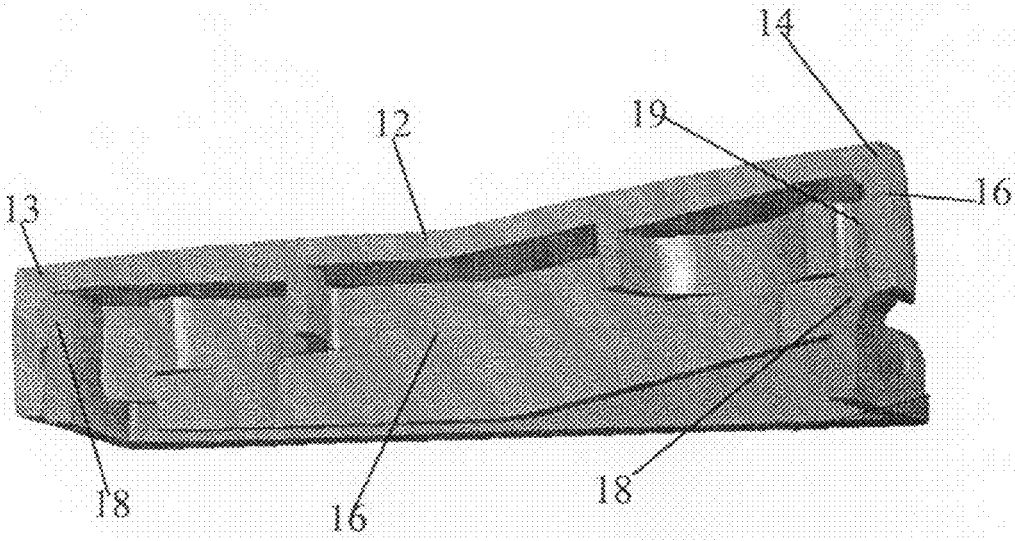
FIG. 7 shows a partial sectional view of the switch disclosed in FIG. 6.

The embodiment of FIGS. 6 and 7 is slightly different from the previous embodiments. Firstly the base part 11 has an upper limit, which is below the top surface of pressure receiving parts 13, 14 irrespective of the position of the switch. This allows the switch to be built into the hearing aid casing 3 in a manner leaving the top rim of the base part hidden under the shell 3 of the hearing aid.

As further seen in FIG. 6, the axle 15 clicks into a recess 17 of the skirt part 11.

For all of the above embodiments, the pivot element may be made with a colour which is different from the colour of the shell 3 of the hearing aid, which has the advantage that caregivers of hearing aid users may easily see the position of the switch. This is due to the fact that at any position of the switch at least one of pressure receiving parts 13, 14 will remain in an elevated position with respect to the shell 3 of the hearing aid and the clear visibility of this elevated part may be underlined by supplying the pivot element 12 in a colour different from the colour of the hearing aid shell 3. Also the elevated position of either the one or the other or both of the pressure receiving parts may aid the hearing aid user to easily determine the position of the switch by way of the sense of feeling in the users fingertips, when the hearing aid is placed at the ear. It is a problem with known hearing aids that the position of switches is not readily determined by fingertip feeling, which leaves the hearing aid user in doubt as to the position of the switch. This may leave the user fumbling about for some time in order to get the desired position of the switch right, but with the switch according to the invention the user may feel immediately the right position of the switch.

As clearly seen in FIG. 4 the switch should be made in a generally flat manner, and this is among others achieved in that the space under the pivot 12 is used to accommodate electronic micro switches 9 as well as the cantilever 18. This allows the switch to be placed in level with the surface of the shell 3 and still not extending into the hearing aid beyond the circuit board 6 thereof. This board is placed just below the internal surface of the shell 3 as seen in FIG. 4. In FIG. 6 the general height of the switch is indicated by arrow H. The height H should be no more than 3 mm, and preferably not be above 2.5 mm. In a most preferred embodiment the height H is 2.4 mm.

The length from the pivot point of axle 15 and the far end of the pressure receiving parts 13,14 is indicated in FIG. 6 by L. The length L and the maximum pivot angle achievable of the pivot 12 defines the height h above the hearing aid shell which the up end of one of the pressure receiving parts may achieve. In a preferred embodiment L and the maximum pivot angle is chosen such that h is no less than 1.4 mm when the maximum elevation of pressure receiving part 14 is reached as indicated in FIG. 6. In order for hearing aid users to be able to clearly feel the position of the push button, the length L needs must be above a predefined value, and it has been learned that for most hearing aid users the length L should not be below 4 mm. If the length L is below 4 mm it becomes difficult and possibly impossible for some users to feel which end of the button is switched to the high position, and which end is depressed. In the most preferred embodiment the length L is 5 mm.

The invention claimed is:

1. Switching device for hearing aid, whereby a hearing aid casing part is adapted for placement above and behind the ear lobe and encloses a battery and a signal processing and amplifier device operable to provide an amplified audio signal to the user perceivable as sound wherein further the switching device comprises a base section and a manually operable rigid pivot element which has two spaced apart pressure receiving parts and a pivotal axis placed between the two pressure receiving parts, whereby a cantilever and indexing ladder is provided between the base section and the rigid pivot element operable to allow the rigid pivot element to assume 2, 3 or more stable positions.

2. Switching device for a hearing aid as claimed in claim 1, wherein each of the pressure receiving parts are operable to alternately assume a stable position flush with the surrounding hearing aid casing part and a stable position raised above the surrounding hearing aid casing part.

3. Switching device for a hearing aid as claimed in claim 2, wherein further one or more stable positions are provided by the cantilever and indexing ladder wherein both pressure receiving parts are raised above the surrounding hearing aid casing part.

4. Switching device for a hearing aid as claimed in claim 2, wherein the cantilever is provided as a part of the base part and the indexing ladder is provided integrally with the pivot element.

5. Switching device for a hearing aid as claimed in claim 2, wherein the pivot element comprises a skirt surrounding each pressure receiving part and extending in the same direction as the force provided by the intended pressure.

6. Switching device for a hearing aid as claimed in claim 5, wherein the skirt at a midpoint between the two pressure receiving parts comprise an axle element operable to facilitate pivotal movement of the pivot element.

7. Switch device for a hearing aid as claimed in claim 5, wherein the skirt in the region of the axle element is weakened such that the central part of the pivot element may flex elastically.

8. Hearing aid with switching device, wherein a hearing aid casing part is adapted for placement above and behind the ear lobe and encloses a battery and a sound processing and amplifier device operable to provide an amplified audio signal to the user perceivable as sound wherein the battery and a speaker is provided close to each other and where the switching device is provided in the region above the battery and the speaker wherein further the switching device comprises a base section and a manually operable rigid pivot element which has two spaced apart pressure receiving parts and a pivotal axis placed between the two pressure receiving parts, whereby a cantilever and indexing ladder is provided between the base section and the rigid pivot element operable to allow the rigid pivot element to assume 2, 3 or more stable positions.

* * * * *

UNITED STATES PATENT AND TRADEMARK OFFICE

CERTIFICATE OF CORRECTION

PATENT NO. : 8,059,846 B2
APPLICATION NO. : 12/450732
DATED : November 15, 2011
INVENTOR(S) : Vaerndal et al.

It is certified that error appears in the above-identified patent and that said Letters Patent is hereby corrected as shown below:

Title Page, Item (73) Assignee should read:

-- OTICON A/S, Smørum (DK) --

Signed and Sealed this
Third Day of January, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,059,846 B2
APPLICATION NO. : 12/450732
DATED : November 15, 2011
INVENTOR(S) : Vaerndal et al.

It is certified that error appears in the above-identified patent and that said Letters Patent is hereby corrected as shown below:

Title Page, Item (22) should read

-- PCT Filed: April 10, 2008 --

Signed and Sealed this
First Day of May, 2012

David J. Kappos

David J. Kappos
*Director of the United States Patent and Trademark Office*